US006006476A

United States Patent [19]

Zarnick

[11] Patent Number: 6,006,476

[45] Date of Patent: Dec. 28, 1999

[54] CONTROLLING ACOUSTICS AND EMISSIVITY IN SPORTS ARENAS AND CONCERT HALLS

[76] Inventor: Bernard F. Zarnick, MBI, 5309 Hamilton Ave., Cleveland, Ohio 44114-3909

[21] Appl. No.: 08/686,690

[22] Filed: Jul. 26, 1996

Related U.S. Application Data

[63] Continuation-in-part of application No. 08/432,606, May 1, 1995, abandoned.

[51] Int. Cl.[6] ..... E04H 3/12; E04B 9/30

[52] U.S. Cl. ..... 52/6; 52/22; 52/144

[58] Field of Search ..... 52/6, 22, 144; 181/210, 284, 286, 287, 291, 294

[56] References Cited

U.S. PATENT DOCUMENTS

| | | | |
|---|---|---|---|
| 1,758,808 | 5/1930 | Sersen et al. | 181/284 |
| 1,845,080 | 2/1932 | Eyring et al. | 181/284 |
| 2,527,031 | 10/1950 | Rambusch | 181/294 |
| 3,021,914 | 2/1962 | Wilson | 181/290 |
| 3,049,190 | 8/1962 | Coffman | 181/287 |
| 3,182,747 | 5/1965 | Wilhelmi et al. | 181/286 |
| 3,255,687 | 6/1966 | Glaser | 181/286 |
| 3,321,877 | 5/1967 | Alexieff | 181/284 |
| 3,469,354 | 9/1969 | Meetze, Jr. | 52/6 |
| 4,137,678 | 2/1979 | Varlonga | 52/144 |
| 4,531,609 | 7/1985 | Wolf et al. | 181/286 |
| 4,920,707 | 5/1990 | Moskaliuk et al. | 52/6 |

*Primary Examiner*—Michael Safavi
*Attorney, Agent, or Firm*—Robert J Fay

[57] ABSTRACT

A system for controlling acoustics and emissivity in an arena having a ceiling includes a pair of rollers mounted adjacent the ceiling and spaced apart over at least a portion thereof. A plurality of acoustics and emissivity controlling panels connected together to form a continuous sheet are mounted between the rollers for movement across the ceiling when the rollers are rotated. The panels include one having a high emissivity surface of at least 90%, one having a low emissivity surface of 7% or less and one having an acoustical surface with sound absorbing characteristics.

5 Claims, 5 Drawing Sheets

FIG. 1

TYPE II

| TYPE | ACOUSTICS | EMISSIVITY | COLOR | EVENT / HEATING / COOLING |
|---|---|---|---|---|
| II A | VERY GOOD ACOUSTICS HIGH ABSORPTION | HIGH EMISSIVITY | BLACK | CONCERT / MUSIC / VOICE ALL SPORTS DURING HEATING CYCLE. |
| II B | VERY GOOD ACOUSTICS HIGH ABSORPTION | LOW EMISSIVITY | SILVER | CONCERT / MUSIC / VOICE ALL SPORTS DURING COOLING CYCLE. |

TYPE III

| TYPE | ACOUSTICS | EMISSIVITY | COLOR | EVENT / HEATING / COOLING |
|---|---|---|---|---|
| III A | HIGH ABSORPTION | LOW E | SILVER | CONCERT / MUSIC / VOICE OR COOLING CYCLE |
| III B | HIGH ABSORPTION | HIGH E | BLACK | CONCERT / MUSIC / VOICE OR HEATING CYCLE |
| III C | LOW ABSORPTION | LOW E | SILVER | HOCKEY OR COOLING CYCLE |
| III D | LOW ABSORPTION | HIGH E | BLACK | BASKETBALL OR HEATING CYCLE |

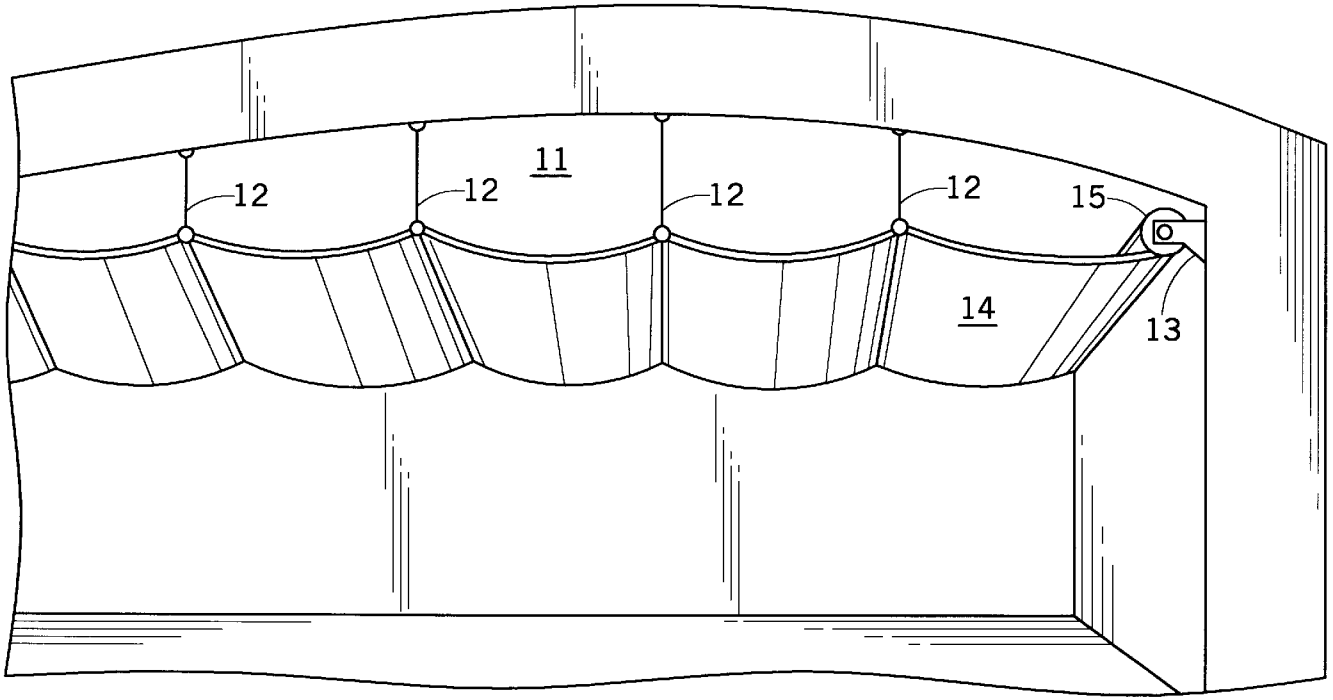
FIG.3
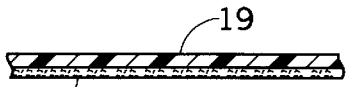
FIG.4
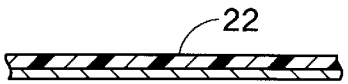
FIG.5
FIG.6
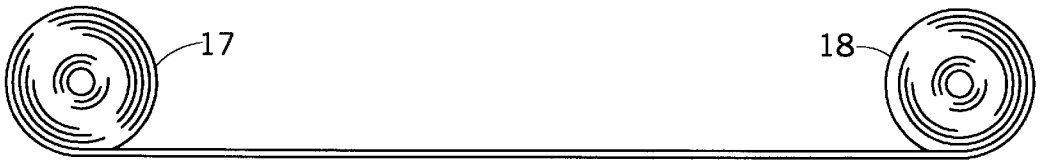
FIG.7

CONTROLLING ACOUSTICS AND EMISSIVITY IN SPORTS ARENAS AND CONCERT HALLS

This application is a continuation-in-part of my application Ser. No. 08/432,606 filed on May 1, 1995, now abandoned.

BACKGROUND OF THE INVENTION

In the area of a sports arena which is a closed building of large size for sports events such as hockey, curling, basketball and indoor soccer, there is a great need for acoustic management in that noise reverberation comes from the walls and ceiling of the building, sometimes with 1–10 second delays.

At the same time, for musical performance and political or religious inspirational talks, there is a similar need for acoustical management so that echoes 1–10 or more seconds later will not mar the performance or dampen the charisma of the speaker. They are dampened to 0.5 to 2.0 seconds.

While there is need for acoustical treatment, the roar of the crowd and its reverberation is an exciting feature of a sporting event. Therefore, there are times when long reverberation is acceptable and other times when it is desirable to dampen it. Sometimes there is a thermal problem for an arena, as in a hockey game or basketball, particularly when the arena is in an air conditioning mode. The arena may have on the ground floor a temperature of 60+ degrees F and a ceiling temperature of 100 degrees F at 150 feet in the air. Ceiling temperatures generally range from 95° F. to 115° F. because heat rises. From the ceiling, the reradiation of emissivity, as distinct from convection heat transfer, will heat the floor to undesirable levels. Thus, the emissivity from a black ceiling would be 98%, and from a white ceiling would be 90%. From a silver or aluminum ceiling, the emissivity Ec will be only 3%. With hockey, the ice would be 25° F. to 30° F. and refrigeration load is then very high if the emissivity is not controlled.

SUMMARY OF THE INVENTION

This invention relates to the combination of the acoustical treatment of ceiling panels as well as the emissivity of the material to produce better environmental treatment of a sports arena or concert hall in either a heating mode or an air conditioning mode. This invention further is to help keep the seating area of the arena comfortable by having high emissive panels over the seating area, particularly when in the heating mode.

The basic feature of the invention is to cover a portion of the ceiling to give a balanced acoustic presentation as well as comfortable balance of temperatures for the public.

In dealing with acoustic and emissivity, there are at least three conditions that are dealt with. Type I is a stationary panel type which has fixed acoustics (which are good) and fixed emissivity (that is, low Ec).

With respect to Type II panel installations, moveable panels, designated as type II, are characterized as having fixed acoustics which are good and variable emissivity (either high or low) which is accomplished by flipping or rotating a series of interconnected panels either manually or mechanically with a powered rotator. One side of the panel has a low emissivity and an aluminum or silver coating for a building air conditioning mode or, ice hockey mode, and the other side has a high emissivity, i.e., black, for a building heating mode. Segmented hanging panels also may be provided.

In a separate example, a rolling panel that exposes three surfaces in sequence is provided as the panel unrolls, a low emissive surface, a high emissive surface and an acoustical surface with sound absorbing fibers that extend when exposed and not when rolled up to allow greater surface on the roll. This is done by constructing a ceiling portion which may be segmented into 4 foot×20 foot panels or 4 foot×40 foot panels which may be formed in a suspended ceiling catenary comprising ½ inch to 6 inches of acoustical material with reinforcing material and then encapsulating it in an aluminum vacuum produced coating with an emissivity of 3%. That means that only 3% of the heat is reradiated to the floor. In a typical sports arena, 150 feet in the air, the temperature will be 100 degrees F and the floor will be 60 degrees F. If it is a hockey arena, the ice will be 25 degrees F with some need for low emissivity in order not to increase the refrigeration load so the ice will stay hard.

A third type is constituted by Type III panels which have variable emissivity, i.e. low emissivity used for cooling an ice hockey game and high emissivity using black or high emissivity for a building heating mode. With no sound absorption on one side, the space would be highly reverberent and with the other side having good sound absorption, low reverberation is effected which is acoustically comfortable. This is shown in the drawings with a hanging panel in the form of triangular cross section rotating panels which have on one side a low emissive surface and on another side a high emissive surface and on a third side, an acoustical surface for good sound absorption.

Though this invention involves mostly ceiling treatment, walls may be important as well.

In this specification, emissivity (Ec) is defined as the ratio of radiation from a surface to the radiation intensity at the same wave length from a black body at the same temperature.

BRIEF DESCRIPTION OF THE DRAWINGS

FIG. 1 is a chart showing the characteristics of Type II and III panels;

FIG. 3 is a perspective view of an arena with a roller curtain of high and low emissivity which is wound on rollers;

FIG. 4 is a cross section of a type II panel which has a black material on the bottom having a high emissivity and a cloth or scrim cover on the top;

FIG. 5 shows an example of a type II rolling panel having cloth on one side, i.e. scrim, and an acoustical layer on the other side;

FIG. 6 is a further example of a Type II rolling panel having a lower surface of aluminum having a low emissivity of 3–5% and scrim cloth on the upper face;

FIG. 7 shows material rolled up on a roller on either side of a roof or ceiling structure wherein the material is one of the materials shown in FIGS. 4, 5 and 6;

DETAILED DESCRIPTION OF THE PREFERRED EMBODIMENTS

Figure 2:
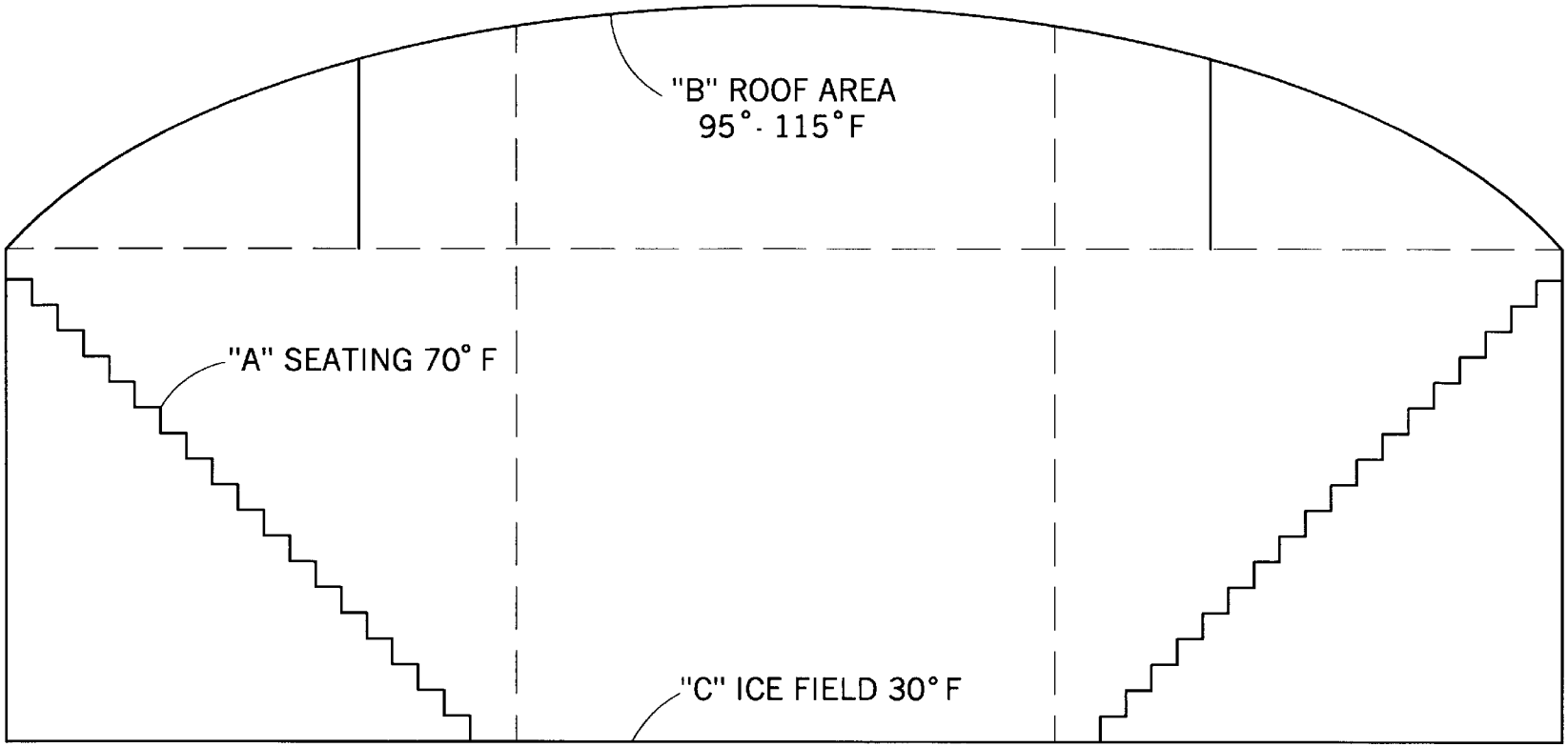
FIG. 2 is a view of an arena showing variations of heat when in an air conditioning mode.

Paying particular attention to the notes relative to type II & III panels, the following is appropriate to FIG. 2.

"A" designates a seating section wherein 70° F. is an ideal temperature but the temperature can be lower, resulting in energy savings on the heating cycle using radiant supplemental heat from "B" or warmer on the cooling cycle (resulting in energy savings) if there is a lack of supplemental radiant energy.

"B" designates a roof area. When "A" is 70° F., "B" can easily be 95° F. and on hot, sunny days, easily 110° F. This is because (1) heat rises due to convection, and (2) heat is entering through the roof. Surfaces located at "B" attain these elevated temperatures principally through conduction from hot air in contact with surfaces.

"C" designates ice used for hockey or skating. Energy is expended to keep it cold at 25° F. to 30° F. Low emissivity at "B" is highly desirable to keep brine refrigeration costs to a minimum.

If the surfaces at the "B" roof area location are black they become ideal 95° F.–110° F. radiant surfaces, radiating their energy to lower temperature surfaces such as 70° F. at "A" seating surfaces and occupants at that location, or ice surface such as 30° F. at the "C" ice field surfaces. The greater the temperature differential, the greater the amount of heat is transferred.

Since acoustical absorption and radiant and non-radiant surfaces all rely on the same area "B", this invention embodies using the same surface to accomplish all functions. In some applications as in type "II B", the acoustical core material combined with a Low E surface also provides thermal performance.

If the surfaces at "B" are close to silver in color, only 3% to 7% of their heat energy will radiate to other surfaces such as "A" and "C", thus giving low emissivity. If "B" surfaces are black, 90%+ heat is radiated from "B" to "A" or "C", thus giving high emissivity.

Having given a generalized view of the invention using the drawings to show examples, a more detailed view of the invention using the two categories of the invention shown in the drawings will be given. They are Moveable Panels Type II, and Moveable Panels Type III.

In the U.S. and Canada, there are sports arenas and concert halls which require a heating mode in the colder months for sports like basketball and hockey and at the same time these same sports are played in warm months in the summer and down south in the U.S. where air conditioning is need almost all the year round.

FIG. 1 shows the characteristics of Type II panels which have fixed good acoustics with variable emissivity which will accommodate sporting events in hot or cold climates and occasional concert/voice events. This could be done with flip panels, triangular or multi sided panes or the segmented hanging panes in FIG. 13 where there is a flat presentation of high Ec and low Ec, and there is never a section.

FIG. 2 shows an arena with an ice field "C" at 30° F., a seating area "A" at 70° F. and a roof area "B" at 95–115° F.

FIG. 3 shows a large group of catenary panels connected to form a continuous sheet and festooned over a ceiling, that is acoustically chosen for noise control with fiberglass, in a panel 11 and various hangers 12. At the ends is a hanger 13 to hold a roller 15 which keeps the catenary taught. The lower surface is treated to provide the right emissivity for the predominate conditions as to climate. In a heating mode the underside 14 might be black having a 95% emissivity. White covering would be 90% emissivity because the heat would normally rise and if the floor were 60 degrees F, the ceiling would be 100 degrees F to balance the heat load for sport fans comfort, about 60 degrees F.

Successive sections of panels 11 on the roller 15 would be low Ec, and could have an acoustic section or others. Here there could be a first section such as shown in FIG. 4 with vinyl scrim 16 on top and a black coating of high Ec on the bottom facing down to the fans. This is wound on the rollers seen at 17 and 18 in sequence for 100 feet or more as shown in FIG. 7.

FIG. 5 shows a structure having a vinyl scrim backing 19 and an acoustical layer 20 that would hang down 1"–3" and provide acoustic noise control as would be needed for a music concert or a speaker. FIG. 6 shows a structure having a vinyl scrim backing 22 and a foil coating of aluminum or silver with an emissivity of 3% which might be used for a hockey match to reduce the refrigeration load.

Figure 9:
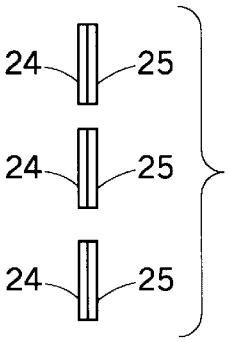
FIG. 9 is an end view showing the two surfaces of the flip panels of FIG. 8.
Figure 8:
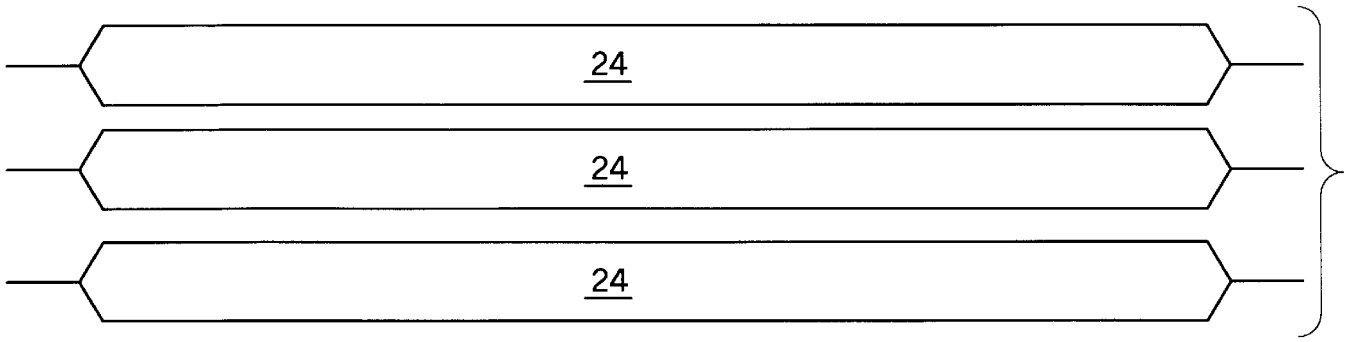
FIG. 8 shows an acoustical baffle treatment of moveable type III panels flip suspended against one wall surface and extending across to an opposite side or wall surface.

FIGS. 8 and 9 show a series of flip panels that are almost touching and have a means at the end for flipping or turning the panels over mechanically or manually. One side of the panel 24 has a low emissivity, such as 3%, and the other side, 25, has a high emissivity of 90–98%. These are moveable type II panels. For a basketball game, the high emissivity side would be down to balance the heat in the winter. For hockey, the low emissivity side would be down.

Figure 11:
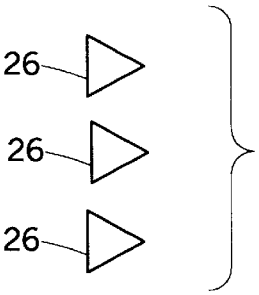
FIG. 11 is an end view showing the panels of the triangle system of FIG. 10.
Figure 10:
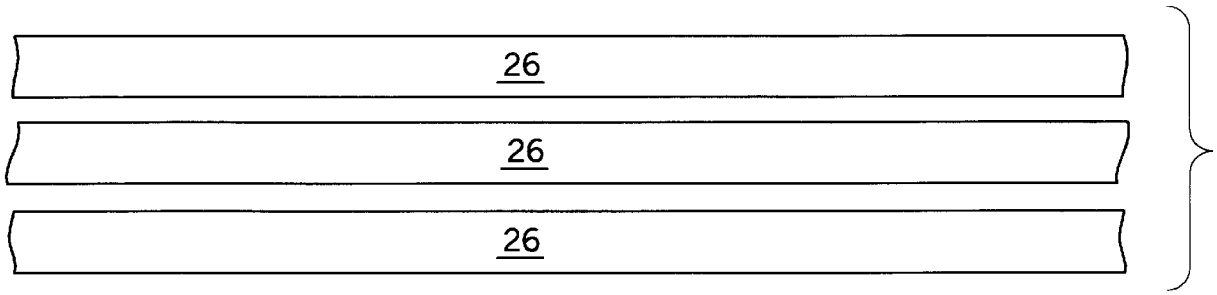
FIG. 10 shows a triangular baffle system having type III forms of fiberglass covered with shrink wrapped covering of high and low emissivity materials.
Figure 12:
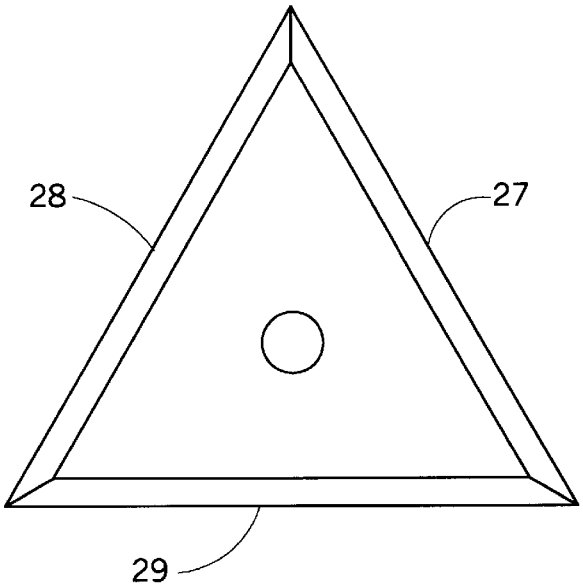
FIG. 12 is an enlarged cross sectional view showing the various faces of the panels of FIG. 11.

FIGS. 10, 11 and 12 show a series of Type III panels 26 formed in a triangle with a side 27 being of low emissivity, another side 28 being both acoustically reflecting and non-absorbent high Ec. The third side 29 is acoustical to keep the noise reverberation down for a musical concert. Each of these panels might have a stiffened layer inside to provide a triangular box as seen in FIG. 12. The characteristics for III type panels are shown in FIG. 1 and set forth below.

III A Sound absorber Silver, Low E

III B Sound absorber Black, High E

Figure 13:
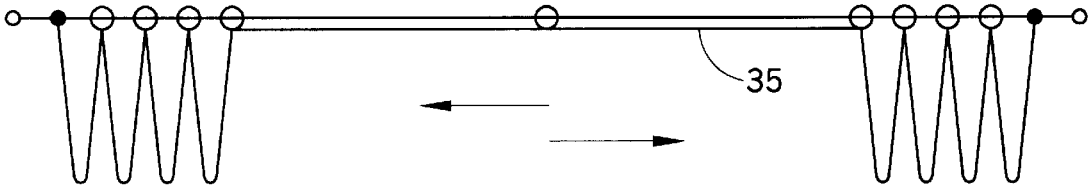
FIG. 13 shows a segmented hanging panel with large loops.

III C Use over field Reflective to sound Non sound absorptive surface Silver, Low E III D Use over seating area Reflective to sound Non sound absorptive surface Black, High E FIG. 13 shows a segmented accordion hanging panel where the flat section 35 is a segment having low Ec. Other segments in the accordion are high Ec, reflective to sound and high Ec, reflective to sound and low Ec, i.e., silver or aluminum.

Most sporting arenas are also musical halls used for classical music or rock concerts. For some events it is necessary to add additional acoustical panels to make it variable to control the reverberation time from 8–10 seconds to 0.5 to 2.5 seconds.

First and foremost, the idea of FIG. 2 where the panels in the ceiling and walls are panels for fixed acoustics and fixed emissivity has great potential and the best features for improved acoustics for weather conditions as well as the correct emissivity for the event, i.e., hockey or basketball. The panels would be fixed or under other conditions they could be on the roller of FIG. 3 and would be 4 feet×20 feet or 4 feet×40 feet covering all or part of the ceiling. Depending on the thickness of the panels, the rollers might extend to 100 feet for each section, i.e., FIGS. 4, 5 and 6 of the ceiling panels.

Another important invention is the idea of a fixed panel 1 inch thick of FIGS. 4, 5 or 6 and 4 feet×40 feet swung in a catenary covering the roof with low or high emissivity covering (see FIG. 3) but with a layer of acoustical material. It could be ½" thick or 2" or 6" thick and always with a vacuum coated emissive layer. Here the difference is that it is vinyl scrim foil (i.e., a layer of vinyl, a nylon scrim and a foil layer).

An example of a new product would be an acoustical tile 1"–4" thick with a vacuum deposited aluminum or a strengthened plastic, thread reinforced member or with scrim and an acoustical layer of 1" to 4" thick deposited on one or both sides of an aluminum coating vacuum deposit.

In a typical new arena, acoustical layers ½"–6" thick are used. These are aluminum coated with the standard supports above which are decking, a layer of insulation 2"–4" and a built up roof. For a hockey rink a hot ceiling is over the ice so that a portion of the ceiling, which might be 100 degrees F, has an emissivity of 3% at most. Convection heat would be a small factor. If this were a cold climate such as in Canada, a black or gray ceiling could be employed. This product would be glued on the decking.

Having this explained the features of my invention I wish only to be limited by the

I claim:

1. A system for controlling acoustics and emissivity in an arena having a ceiling comprising:

a pair of rollers mounted adjacent said ceiling and spaced apart over at least a portion of said ceiling;

a plurality of acoustic and emissivity controlling panels connected together to form a continuous sheet; said sheet of panels being mounted between said rollers whereby rotation of said rollers causes said sheet of panels to move across at least a portion of said ceiling;

a plurality of hangers mounted to or adjacent said ceiling which support said sheet of panels between said rollers to form a plurality of catenary panels; and wherein said panels include one having a high emissivity surface of at least 90% and is a black material, one having a low emissivity surface of 3% and is aluminum or silver, and one having an acoustical surface with sound absorbing characteristics.

2. A system for controlling acoustics and emissivity in an arena having a ceiling comprising:

a pair of rollers mounted adjacent said ceiling and spaced apart over at least a portion of said ceiling;

a plurality of acoustic and emissivity controlling panels connected together to form a continuous sheet, said sheet of panels being mounted between said rollers whereby rotation of said rollers causes said sheet of panels to move across at least a portion of said ceiling; and wherein said panels include one having a high emissivity surface of at least 90%, one having a low emissivity surface of 7% or less and one having an acoustical surface with sound absorbing characteristics.

3. A system according to claim 2 which further includes a plurality of hangers mounted to or adjacent said ceiling which support said sheet of panels between said rollers to form a plurality of catenary panels.

4. A system according to claim 2 wherein said low emissivity surface is aluminum or silver.

5. A system according to claim 2 wherein said high emissivity surface is a black material.

* * * * *